US010017298B2

(12) United States Patent
Biber

(10) Patent No.: US 10,017,298 B2
(45) Date of Patent: Jul. 10, 2018

(54) NESTING DINNERWARE

(71) Applicant: Lifetime Brands, Inc., Garden City, NY (US)

(72) Inventor: Hugh William Biber, New York, NY (US)

(73) Assignee: LIFETIME BRANDS, INC., Garden City, NY (US)

( * ) Notice: Subject to any disclaimer, the term of this patent is extended or adjusted under 35 U.S.C. 154(b) by 98 days.

(21) Appl. No.: 15/287,393

(22) Filed: Oct. 6, 2016

(65) Prior Publication Data

US 2018/0099782 A1 Apr. 12, 2018

(51) Int. Cl.

| | |
|---|---|
| ***A47G 19/02*** | (2006.01) |
| ***B65D 21/02*** | (2006.01) |
| ***A47G 19/22*** | (2006.01) |

(52) U.S. Cl.

CPC ..... *B65D 21/0233* (2013.01); *A47G 19/02* (2013.01); *A47G 19/2205* (2013.01)

(58) Field of Classification Search

CPC . B65D 21/0233; A47G 19/02; A47G 19/2205
USPC ..... 206/546
See application file for complete search history.

(56) References Cited

U.S. PATENT DOCUMENTS

| | | | | |
|---|---|---|---|---|
| 1,163,211 | A * | 12/1915 | Chandler | A47J 45/061 126/38 |
| 2,619,816 | A | 10/1948 | Lyon | |
| 3,257,024 | A | 6/1966 | Semanchik | |
| 4,461,396 | A | 7/1984 | Harper | |
| 6,474,494 | B1 | 11/2002 | Miller | |
| 7,380,412 | B2 | 6/2008 | Roth et al. | |
| 9,132,932 | B2 | 9/2015 | Scharfe et al. | |
| 2013/0175277 | A1 | 7/2013 | Leahy et al. | |
| 2015/0272357 | A1 | 10/2015 | Rene Porte | |

FOREIGN PATENT DOCUMENTS

| | | |
|---|---|---|
| CN | 201759268 U | 3/2011 |
| CN | 102670020 A | 9/2012 |
| CN | 204445203 U | 7/2015 |

OTHER PUBLICATIONS

Amazon.com: GSI Outdoors Ultralight Nesting Bowl and Mug: Camping Mess Kits: Automotive. http://www.amazon.com/GSI-Outdoors-77197-Nesting_Bowl/dp/B0010PEXGY. Viewed on Feb. 2, 2016. pp. 1-5.

* cited by examiner

*Primary Examiner* — Stephen Castellano
(74) *Attorney, Agent, or Firm* — Tutunjian & Bitetto, P.C.

(57) ABSTRACT

A set of nesting dinnerware includes a bowl, a mug and a plate. The dimensions of the mug are such that the same can fit within the bowl, either in an upright or rotated position. The base of the plate is configured to fit over the upper opening of the bowl. Once the mug is inserted in the bowl, the base of the plate is positioned over the opening of the bowl, creating a nested set of dinnerware. Multiple sets of nested dinnerware can be stacked on top of each other to further save space.

6 Claims, 9 Drawing Sheets

NESTING DINNERWARE

BACKGROUND

1. Technical Field

The present principles relate to dinnerware and the storage of the same. More particularly, it relates a dinnerware design that enables the nesting of a place setting for more efficient storage.

2. Related Art

Cabinet space in a household or even a commercial environment is usually a commodity. As such, the efficient use of space is a constant requirement in order to safely store, for example, many place settings of dinnerware in limited space.

Prior to the present principles, there is no known dinnerware design that is directed at such space saving concepts.

SUMMARY

According to an implementation, the set of nesting dinnerware includes a bow, a mug and a plate. The bowl has an upper opening, an interior diameter of said upper opening, and a height. The mug has a height and a total width including a mug handle and a partial width that does not include the mug handle. The plate has a base configured to be positioned over the upper opening of the bowl. The mug is sized to fit within the bowl, and once the mug is inserted into the bowl, the base of the plate is positioned over the upper opening of the bowl.

According to another implementation, the nesting dinnerware includes a plurality of bowls, a plurality of mugs and a plurality of plates. The bows have an upper opening, an interior diameter of the upper opening, and a height. The mugs have a height and a total width including a mug handle. The plates have a base configured to be positioned over the upper opening of the bowl. A first mug fits within a first bowl in either an upright or rotated position, and once the first mug is inserted into the first bowl, the base of a first plate is positioned over the upper opening of the first bowl creating a first nested set of dinnerware. A second mug is positioned within a second bowl, and a second plate is positioned over the second bowl creating a second nested set of dinnerware. The second set of nested dinnerware can be stacked on top of the first set of nested dinnerware.

These and other aspects, features and advantages of the present principles will become apparent from the following detailed description of exemplary embodiments, which is to be read in connection with the accompanying drawings.

BRIEF DESCRIPTION OF THE DRAWINGS

The present principles may be better understood in accordance with the following exemplary figures, in which.

DETAILED DESCRIPTION

The present principles are directed to the storage of dinnerware.

The present description illustrates the present principles. It will thus be appreciated that those skilled in the art will be able to devise various arrangements that, although not explicitly described or shown herein, embody the present principles and are included within its spirit and scope.

All examples and conditional language recited herein are intended for pedagogical purposes to aid the reader in understanding the present principles and the concepts contributed by the inventor(s) to furthering the art, and are to be construed as being without limitation to such specifically recited examples and conditions.

Moreover, all statements herein reciting principles, aspects, and embodiments of the present principles, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Reference in the specification to "one embodiment" or "an embodiment" of the present principles, as well as other variations thereof, means that a particular feature, structure, characteristic, and so forth described in connection with the embodiment is included in at least one embodiment of the present principles. Thus, the appearances of the phrase "in one embodiment" or "in an embodiment", as well any other variations, appearing in various places throughout the specification are not necessarily all referring to the same embodiment.

Figure 1:
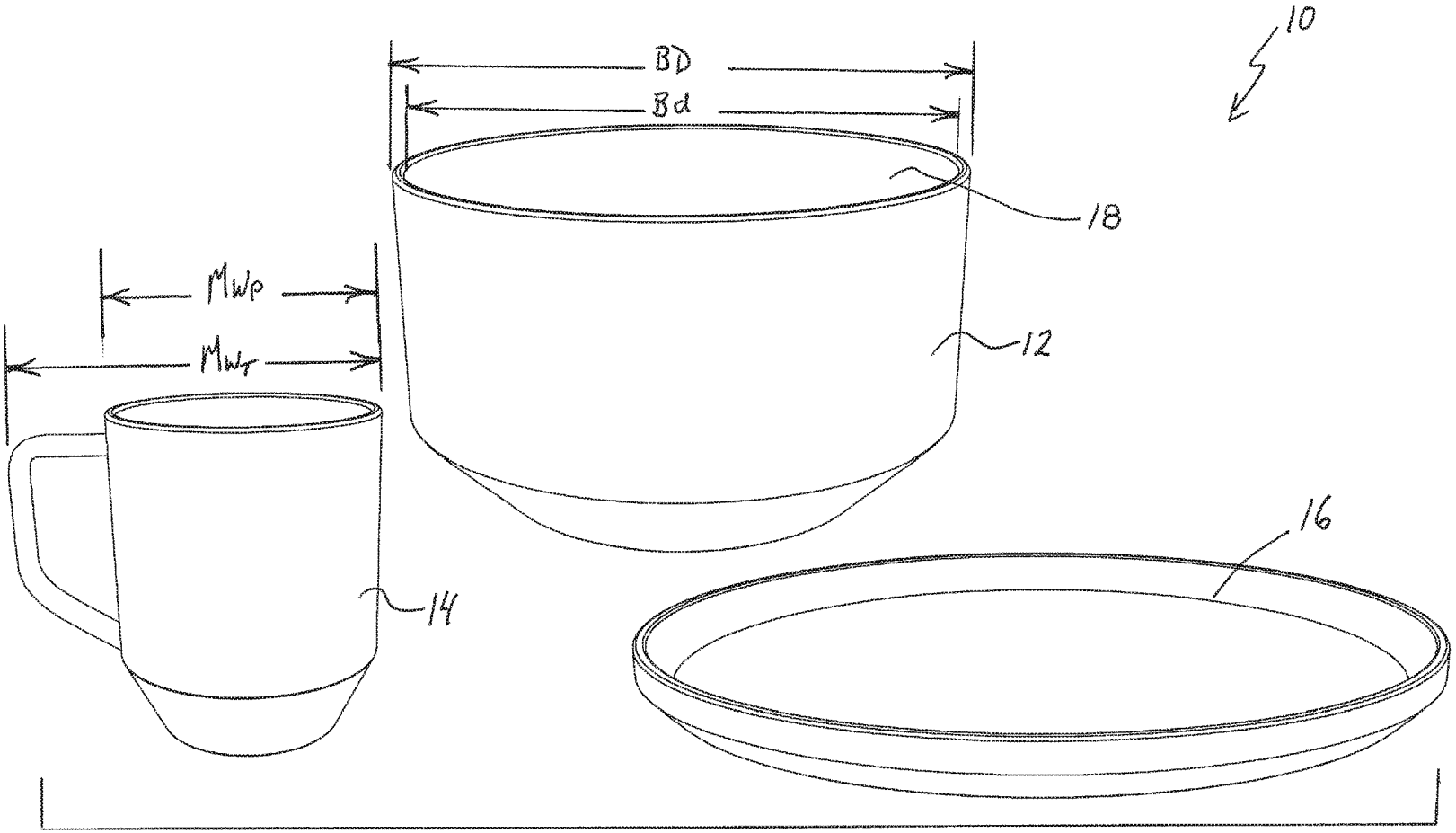
FIG. 1 is a plan view of one place setting of dinnerware with three separate pieces, according to an implementation of the present principles.

FIGS. 1-5 show a first implementation of the nesting dinnerware storage according to the present principles. Referring to FIG. 1, a place setting 10 of dinnerware is shown. More specifically, a bowl 12, a mug 14 and a plate 16 are included in the place setting. The bowl 12 has an opening 18 defined by a predetermined opening diameter Bd. The bowl 12 also has an outer diameter BD which is slightly larger than the opening diameter Bd.

Figure 2:
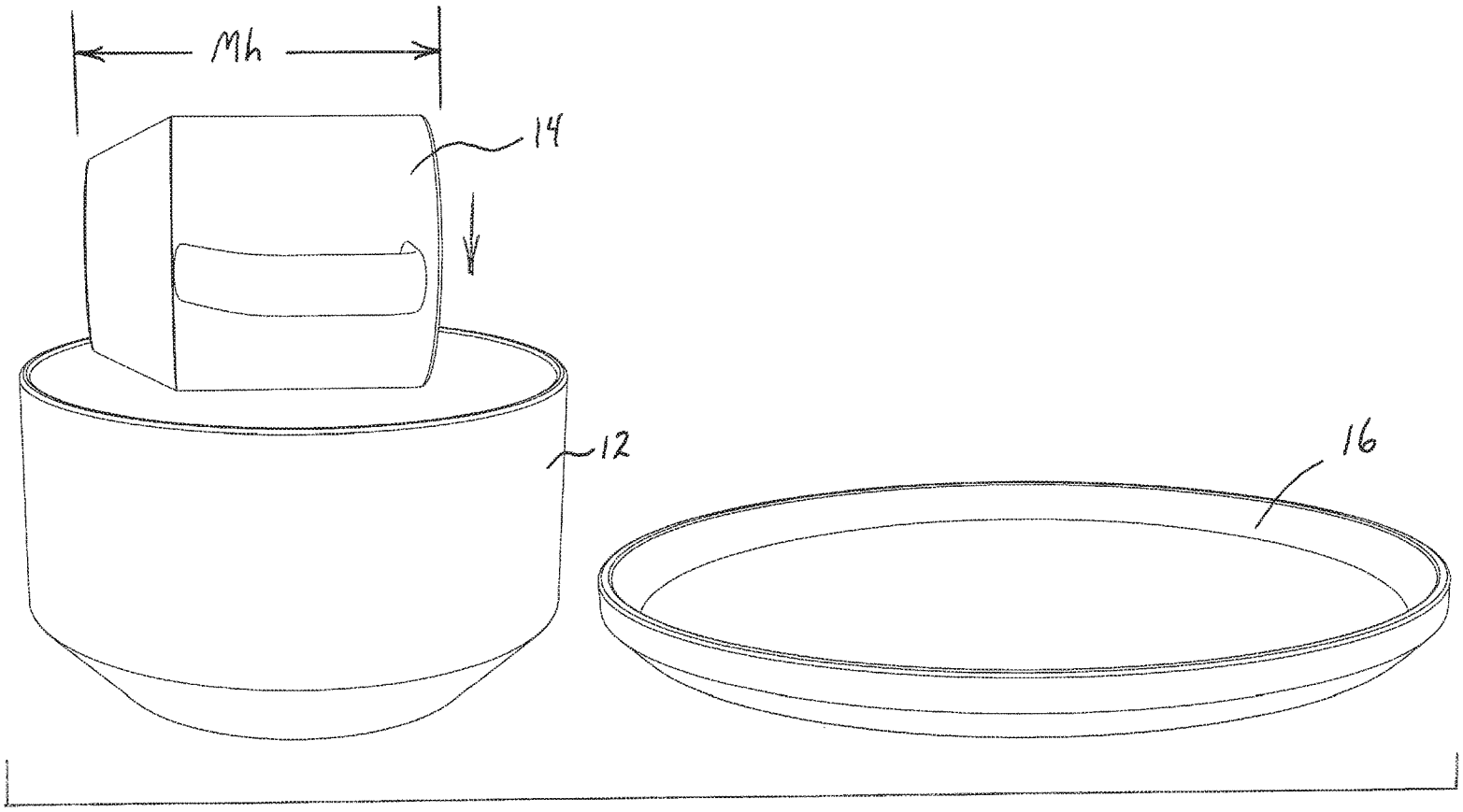
FIG. 2 is a plan view showing the first step in the storage of the dinnerware, according to an implementation of the present principles.
Figure 3:
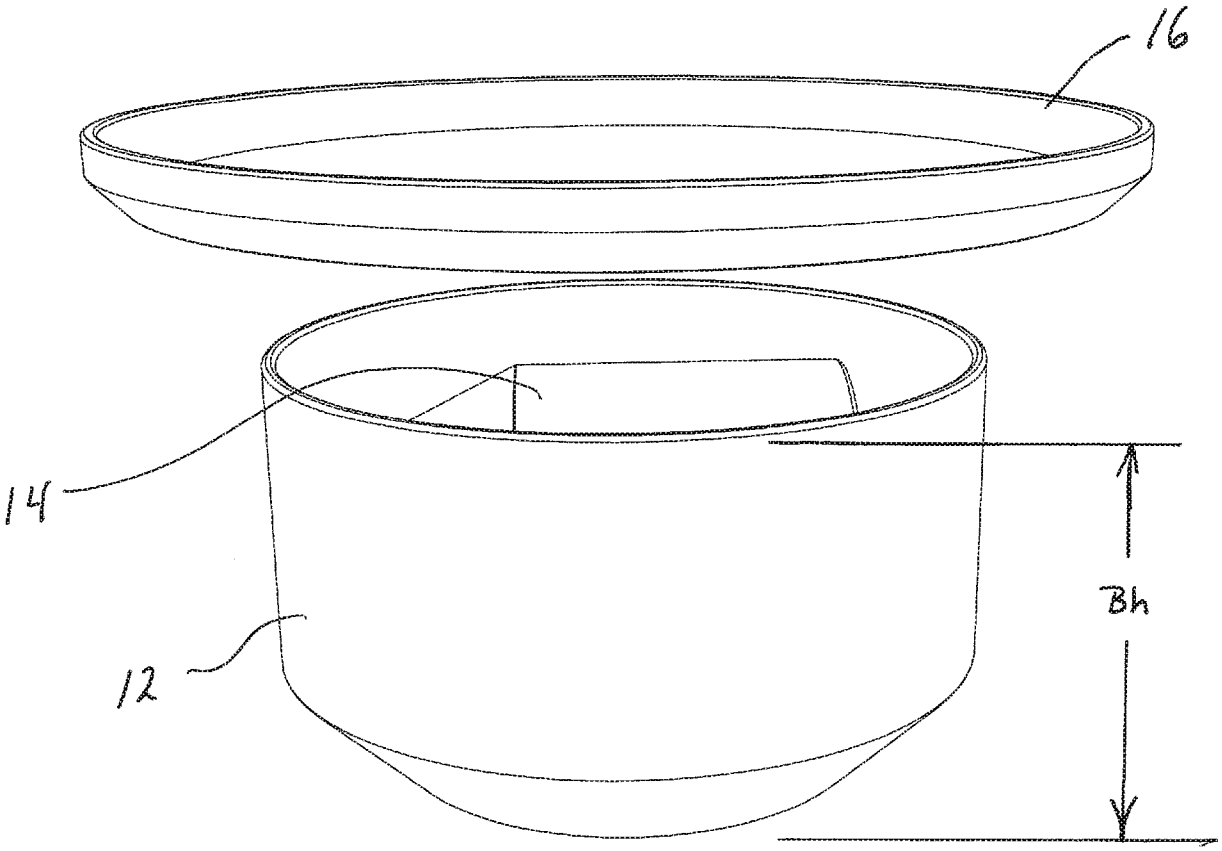
FIG. 3 is a plan view of the second step in the storage of the dinnerware, according to an implementation of the present principles.
Figure 4:
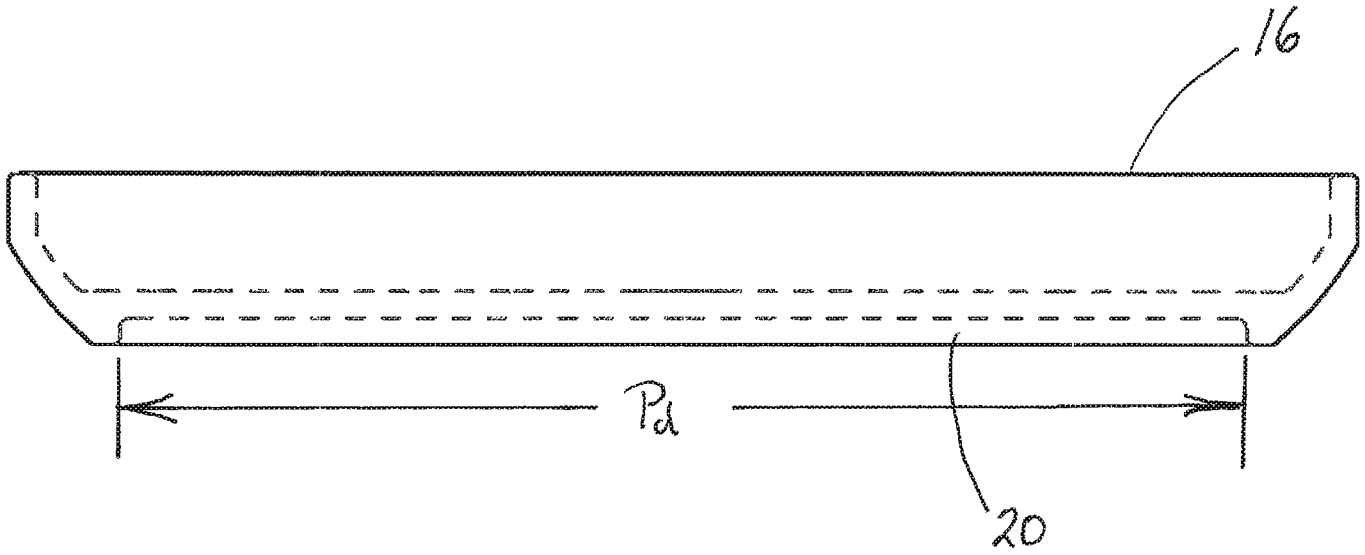
FIG. 4 is a schematic view of the plate within the place setting of dinnerware, according to an implementation of the present principles.

In accordance with this implementation, the mug 14 is turned on its side and inserted into the opening 18 of the bowl (See FIG. 2). As will be appreciated from the drawings, the mug 14 has a height Mh smaller than the opening diameter Bd in the bowl 12 so as to allow the same to fit therein as shown. Additionally, mug 14 also has an overall width Mw that is also smaller than the Bowl opening diameter Bd, and a partial width Mwp that is smaller than the height Bh of the bowl. With this configuration, mug 14 can be inserted into the bowl 12 on its side, and will completely fit within the same. (See FIG. 3).

According to another aspect of the present principles plate 16 includes an underside recess 20 having a length or diameter Pd that is configured to be slightly larger than the outer diameter BD of the bowl 12. (See FIG. 4). As such, one mug 14 is inserted into bowl 14 (while on its side), the recess 20 in the bottom of plate 16 will be received by the top of bowl 12, and thereby secures the nesting storage configuration of the place setting of dinnerware. (See FIG. 5)

Figure 5:
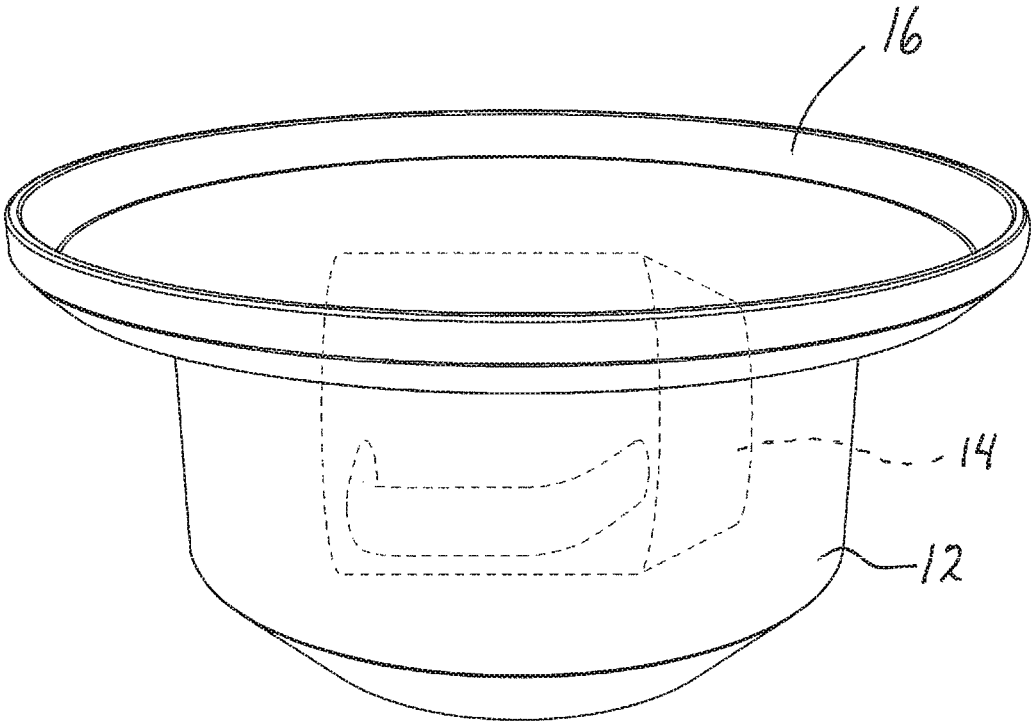
FIG. 5 is a plan view of the completely stored/nested place setting of dinnerware, according to an implementation of the present principles.
Figure 6:
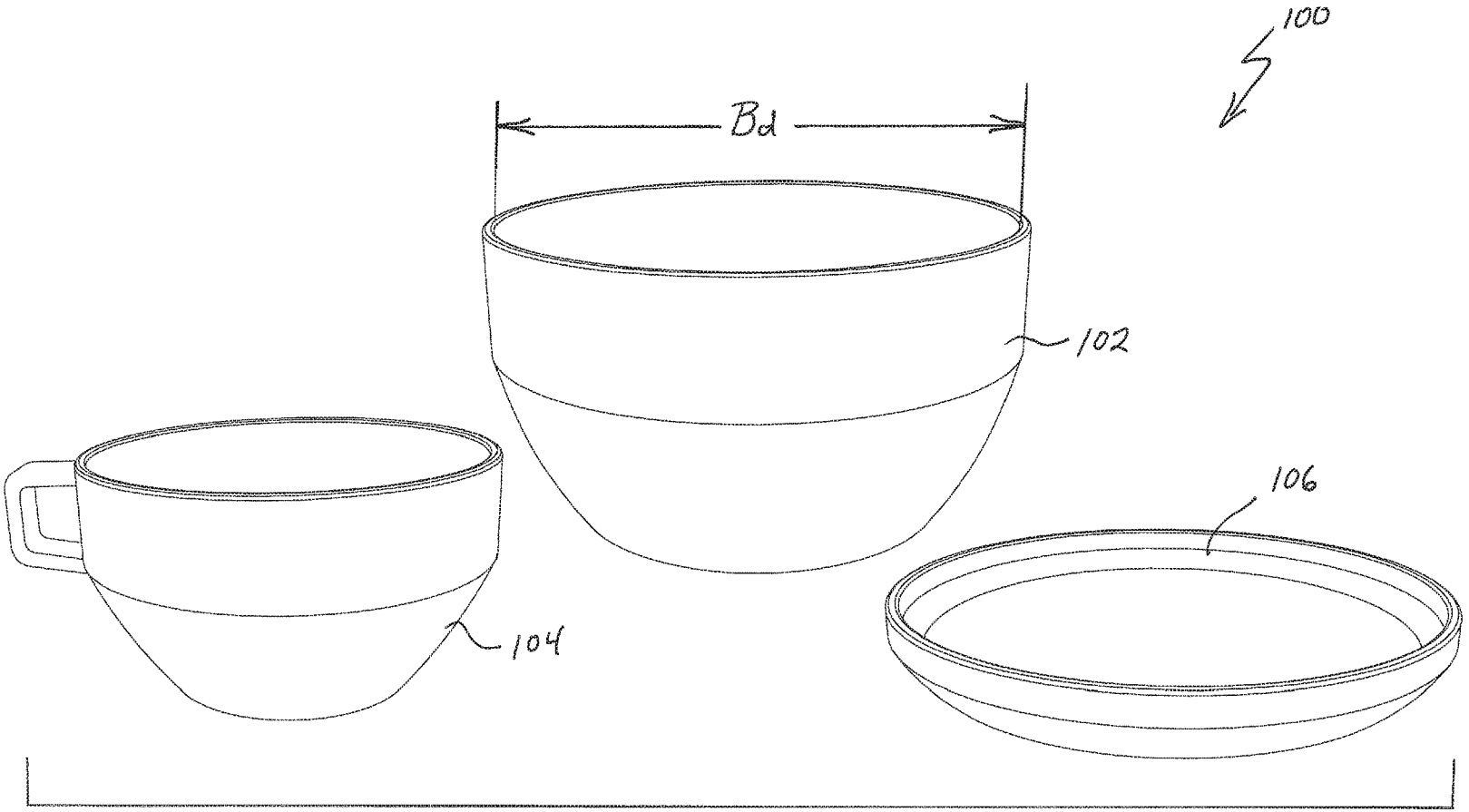
FIG. 6 is a plan view of another place setting of dinnerware with three separate pieces, according to another implementation of the present principles.

It will be further appreciated that once one place setting is nested as shown in FIG. 5, another nested place setting could be stacked on top of the same.

FIGS. 6-9 show another implementation of the nesting dinnerware 100 according to the present principles. As before, we have a bowl 102, a mug 104 and a plate 106.

Figure 7:
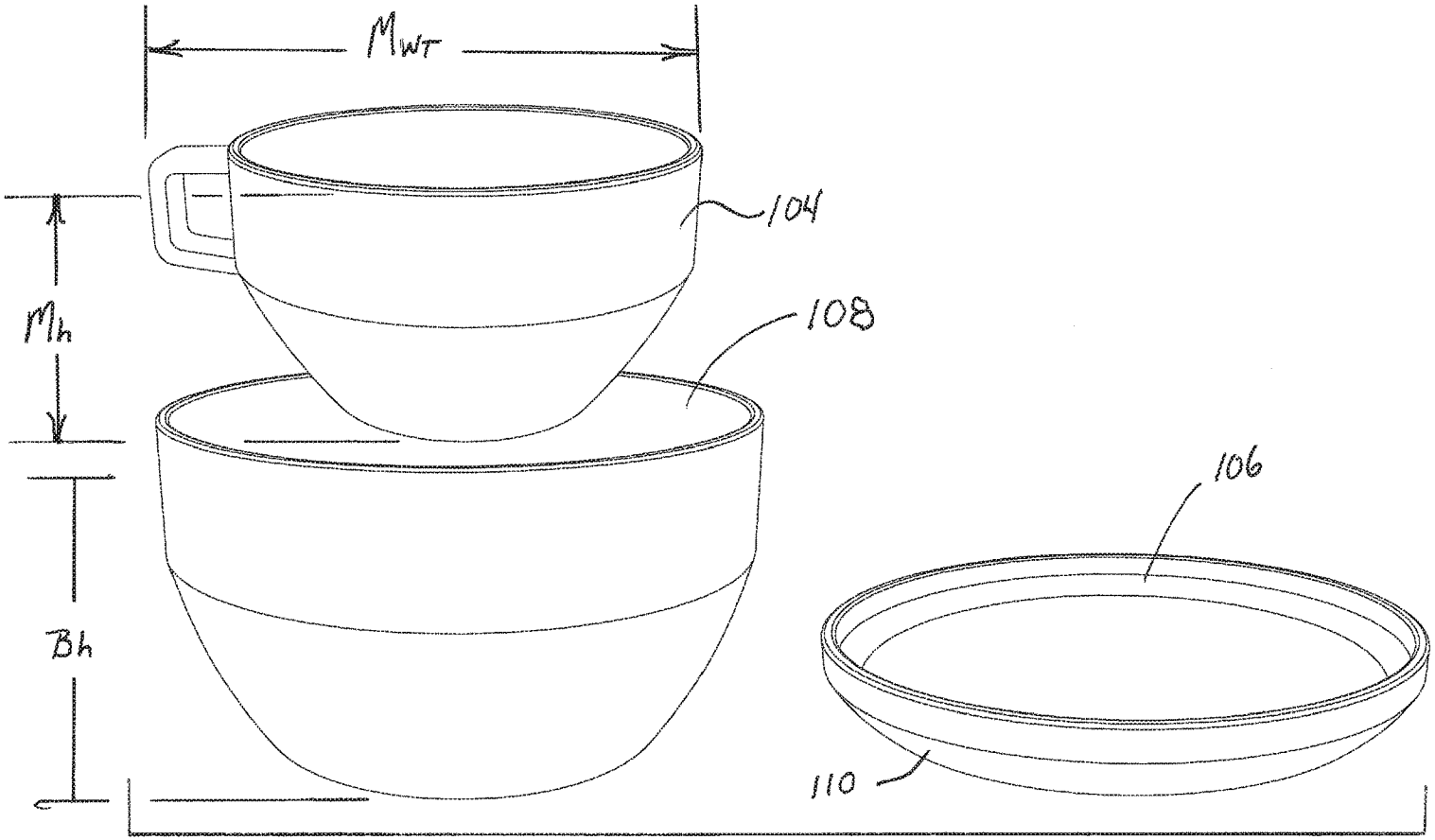
FIG. 7 is a plan view showing the first step in the storage of the dinnerware, according to the another implementation of the present principles.
Figure 8:
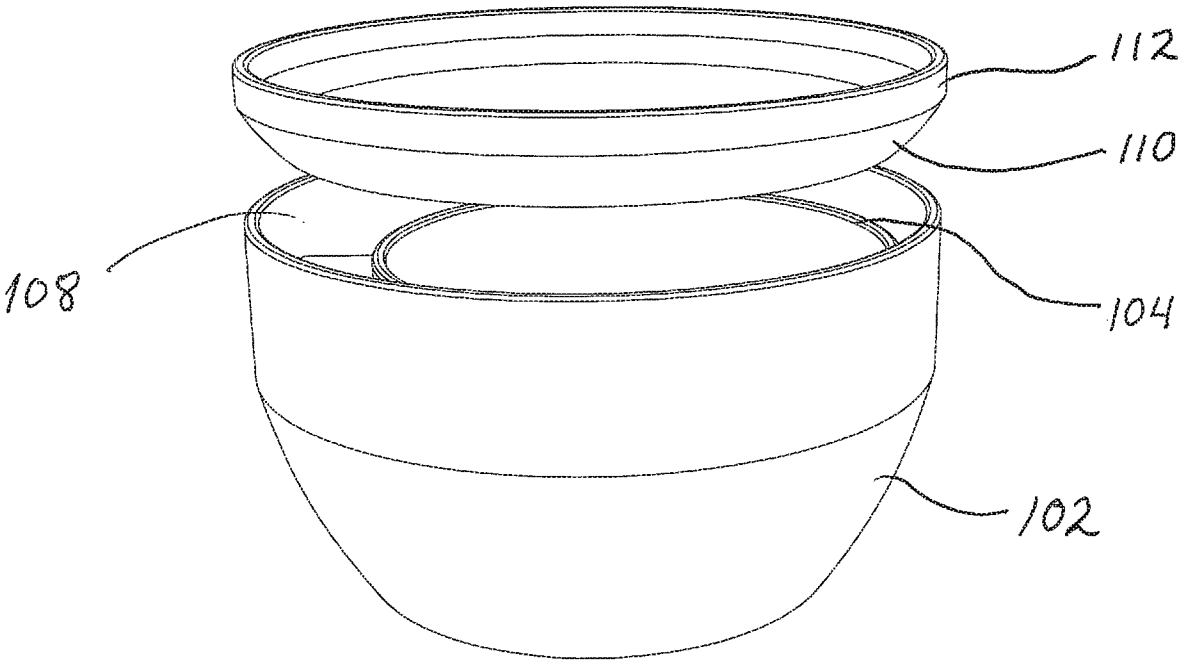
FIG. 8 is a plan view of the second step in the storage of the dinnerware, according to another implementation of the present principles.
Figure 9:
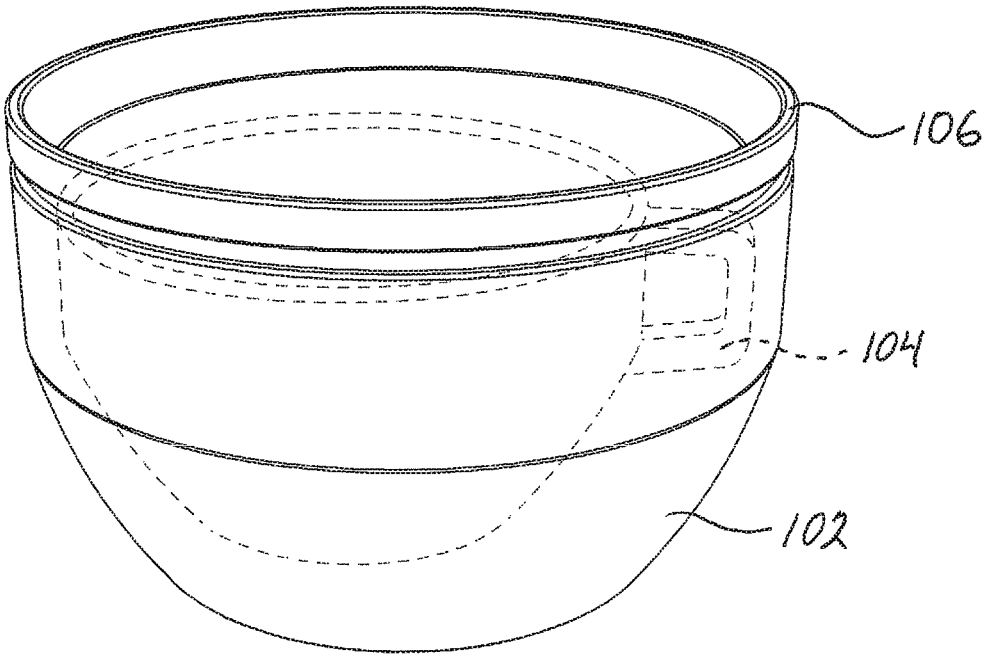
FIG. 9 is a plan view of the completely stored/nested place setting of dinnerware, according to another implementation of the present principles.

In this implementation, the total mug width MWT is configured to be less than the interior bowl diameter Bd such that the mug 104 can be inserted into the bowl 102 in an upright position (See FIGS. 7-9). The plate 106 includes an angled base portion or annular surface 110 that has an increasing diameter from the bottom or base thereof up to the plate edge 112.

Once the mug 102 is positioned within the bowl 102, the plate 106 is positioned over the bowl such that the angled surface 110 fits within the opening 108 and rests therein to close or complete the nesting of the mug within the bowl. It will be appreciated that the range in diameter of the angled surface is such that the same will be smaller than the interior diameter Bd of the bowl 102 at its lowest or base, and as the diameter of the angled surface 110 increases, at a predetermined point the same is equal to and then greater than the interior diameter Bd of the bowl 102. As such, the angled surface of the bowl fits perfectly into the bowl opening 108 to enclose the mug within the bowl, and such that the plate 106 does not slide off or have any tendency to move in any direction.

As with the previously described implementation, once nested as shown in FIG. 9, additional place settings could be stacked on top of each other.

Although the illustrative embodiments have been described herein with reference to the accompanying drawings, it is to be understood that the present principles is not limited to those precise embodiments, and that various changes and modifications may be effected therein by one of ordinary skill in the pertinent art without departing from the scope or spirit of the present principles. All such changes and modifications are intended to be included within the scope of the present principles as set forth in the appended claims.

What is claimed is:

1. A set of nesting dinnerware comprising:

a bowl having an upper opening, an interior diameter of said upper opening, and a height;

a mug having a height and a total width including a mug handle and a partial width that does not include the mug handle; and a plate having a base configured to be positioned over the upper opening of the bowl, wherein the height of the mug is greater than the height of the bowl, the partial width of the mug is less than the height of the bowl; and the total width of the mug is less than the interior diameter of said upper opening of the bowl, such that said mug is placed within the bowl on its side, and once the mug is inserted into the bowl, the base of the plate is positioned over the upper opening of the bowl.

2. The set of nesting dinnerware of claim 1, wherein the bowl further comprises an outer diameter, slightly larger than said inner diameter and said base of the plate further comprises a recess having a diameter slightly larger than the outer diameter of the bowl, such that said recess in said plate fits over the outer diameter of the bowl when positioned on top thereof.

3. The set of nesting dinnerware of claim 1, wherein the base of the plate further comprises an angled surface having a varying diameter from a bottom to a top thereof, said varying diameter at some point along the same equaling the interior opening diameter of the bowl such that the base of the plate is received and secured within said upper opening.

4. A set of nesting dinnerware comprising:

a bowl having an upper opening, an interior diameter of said upper opening, and a height;

a mug having a height and a total width including a mug handle and a partial width that does not include the mug handle; and a plate having a base configured to be positioned over the upper opening of the bowl, wherein the height of the mug is greater than the height of the bowl and the partial width of the mug is less than the height of the bowl such that said mug is placed within the bowl on its side, and once the mug is inserted into the bowl, the base of the plate is positioned over the upper opening of the bowl.

5. The set of nesting dinnerware of claim 4, wherein the bowl further comprises an outer diameter, slightly larger than said inner diameter and said base of the plate further comprises a recess having a diameter slightly larger than the outer diameter of the bowl, such that said recess in said plate fits over the outer diameter of the bowl when positioned on top thereof.

6. The set of nesting dinnerware of claim 4, wherein the base of the plate further comprises an angled surface having a varying diameter from a bottom to a top thereof, said varying diameter at some point along the same equaling the interior opening diameter of the bowl such that the base of the plate is received and secured within said upper opening.

* * * * *